US010828526B2

(12) United States Patent
Grimes et al.

(10) Patent No.: US 10,828,526 B2
(45) Date of Patent: Nov. 10, 2020

(54) EXERCISE APPARATUS AND SYSTEMS FOR USING SAME

(71) Applicant: TUTFM, INC., Montgomery, AL (US)

(72) Inventors: Edward R. Grimes, Montgomery, AL (US); Raymond "Buzz" Powell, Grady, AL (US); Daniel Danley, Opelika, AL (US)

(73) Assignee: TUTFM, LLC, Montgomery, AL (US)

( * ) Notice: Subject to any disclaimer, the term of this patent is extended or adjusted under 35 U.S.C. 154(b) by 0 days.

(21) Appl. No.: 16/197,446

(22) Filed: Nov. 21, 2018

(65) Prior Publication Data

US 2019/0151702 A1 May 23, 2019

Related U.S. Application Data

(60) Provisional application No. 62/589,648, filed on Nov. 22, 2017.

(51) Int. Cl.

| | |
|---|---|
| ***A63B 21/06*** | (2006.01) |
| ***A63B 21/072*** | (2006.01) |
| ***A63B 21/00*** | (2006.01) |

(52) U.S. Cl.

CPC ..... *A63B 21/0616* (2015.10); *A63B 21/0601* (2013.01); *A63B 21/0607* (2013.01); *A63B 21/0617* (2015.10); *A63B 21/0724* (2013.01); *A63B 21/4035* (2015.10)

(58) Field of Classification Search

CPC ..... A63B 21/0616; A63B 21/0617; A63B 21/0601; A63B 21/0607; A63B 21/0724; A63B 21/4035; A63B 21/0632; A63B 21/00058; A63B 2244/09; A63B 2053/0495; A63B 21/00061; A63B 21/00065; A63B 21/06; A63B 21/072; A63B 69/345; A63B 69/34

USPC ..... 482/51; 473/441, 445; 434/247

See application file for complete search history.

(56) References Cited

U.S. PATENT DOCUMENTS

| | | | | |
|---|---|---|---|---|
| 9,643,040 | B1 * | 5/2017 | Guerrero Diaz | A63B 21/4035 |
| 2010/0285934 | A1 * | 11/2010 | Abelbeck | A63B 21/00072 482/97 |
| 2015/0032236 | A1 * | 1/2015 | Yu | A63B 71/0686 700/91 |

(Continued)

FOREIGN PATENT DOCUMENTS

KR 101757587 B1 * 7/2017

OTHER PUBLICATIONS

Wright Equipment, Tire Flip Machine, Sep. 26, 2019, https://www.youtube.com/watch?v=VnpD3Mkt6_I (Year: 2019).*

*Primary Examiner* — Loan B Jimenez
*Assistant Examiner* — Thao N Do
(74) *Attorney, Agent, or Firm* — Ballard Spahr LLP

(57) ABSTRACT

Apparatus, systems, and methods for executing a "tire flip" weight lifting exercise. The disclosed apparatus includes a chassis and a tire assembly that is lifted and flipped during the exercise. The tire assembly includes a support bar that extends through a tire. The tire assembly also includes bearing assemblies that engage arms of a torsion bar that is pivotable with respect to the chassis to provide for safe and controlled movement of the tire assembly during the lifting exercise. When the lift is completed, rollers engage the tire assembly so that the tire assembly can roll back to the starting position at least in part due to the force of gravity.

19 Claims, 16 Drawing Sheets

(56) References Cited

U.S. PATENT DOCUMENTS

| | | | | |
|---|---|---|---|---|
| 2016/0361585 | A1* | 12/2016 | Gagnon | A63B 21/4023 |
| 2018/0078809 | A1* | 3/2018 | Tyree | A63B 21/0616 |
| 2019/0134451 | A1* | 5/2019 | McCall | A63B 21/157 |

* cited by examiner

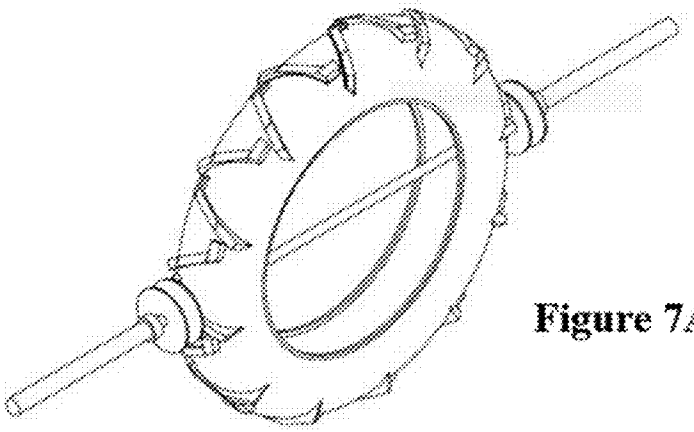
Figure 7A
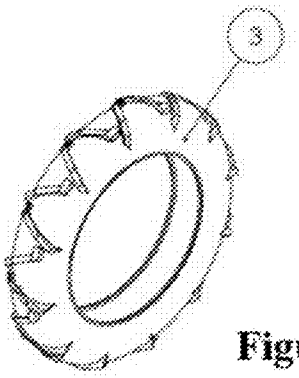
Figure 7B
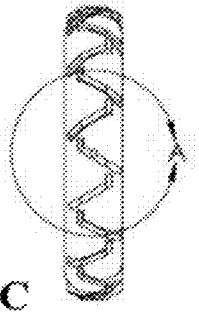
Figure 7C
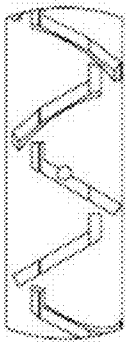
Figure 7D
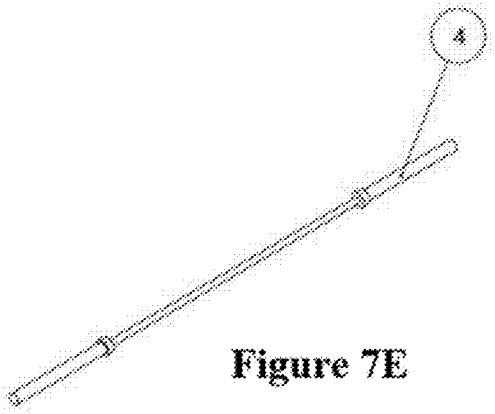
Figure 7E
Figure 7F
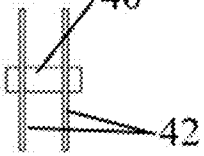
Figure 7G

EXERCISE APPARATUS AND SYSTEMS FOR USING SAME

CROSS-REFERENCE TO RELATED APPLICATIONS

This application claims priority to and the benefit of the filing date of U.S. Provisional Patent Application No. 62/589,648, filed Nov. 22, 2017, which is incorporated herein by reference in its entirety.

FIELD

This invention relates to an exercise apparatus, and, more particularly, to a tire flipping apparatus. Systems and methods of using the exercise apparatus are also described.

BACKGROUND

Exercises that involve the flipping of a heavy tire are gaining in popularity as a fundamental training element in both professional and amateur athletics as well as in non-competitive personal fitness programs. These lifts require large, open spaces where there is sufficient room to flip over a relatively large tire from a first side onto its opposite side. Because such a lift is space intensive, it is often done outside; consequently, this lift is not available in most gyms and weight rooms. There is a need for a stationary exercise apparatus that provides the challenge and benefit of a traditional tire flip in a relatively small space.

SUMMARY

Disclosed herein, in one aspect, is an exercise apparatus having a chassis and a tire assembly. The chassis can have a base portion and first and second support walls. The base portion can have an upper surface, opposed front and back surfaces, and opposed first and second side surfaces. The upper surface can have an upward slope moving from the front surface toward the back surface relative to an axis of movement. The first and second support walls can have lower portions that are respectively secured to the first and second side surfaces of the base portion. Each of the first and second support walls can extend upwardly from the upper surface of the base portion. Each of the first and second support walls can further include a guide rail having an arcuate profile moving along the axis of movement. An upper surface of the lower portion and a lower surface of the guide rail of each support wall can cooperate to define an opening within the support wall.

The tire assembly can have a tire, a support bar, and first and second clutch bearings. The tire can define first and second through-openings positioned in alignment relative to a transverse axis. The support bar can extend through the first and second through-openings of the tire. The tire can be positioned between opposing first and second end portions of the support bar relative to the transverse axis. The first end portion of the support bar can extend through the opening of the first support wall of the chassis, and the second end portion of the support bar can extend through the opening of the second support wall of the chassis. The first and second clutch bearings can be respectively coupled to the first and second end portions of the support bar. In use, the first and second clutch bearings can respectively engage the lower surfaces of the guide rails of the first and second support walls to permit controlled movement of the support bar along the arcuate profiles of the guide rails in response to lifting and/or flipping of the tire. Optionally, plate weights or other weight members can be secured to the support bar to selectively adjust the effective weight of the tire assembly.

In some exemplary embodiments, an exercise apparatus can include a chassis having a base portion having an upper surface, opposed front and back surfaces, and opposed first and second side surfaces. The upper surface can have an upward slope moving from the front surface toward the back surface relative to an axis of movement. A torsion bar can be pivotable with respect to the base about a transverse axis that is substantially perpendicular to the axis of movement. The torsion bar can include a first arm and a second arm that extend substantially radially from the transverse axis. A tire assembly can include a tire defining first and second through-openings positioned in alignment relative to the transverse axis. A support bar can extend through the first and second through-openings of the tire. The tire can be positioned between opposing first and second end portions of the support bar relative to the transverse axis. First and second bearing assemblies can be respectively coupled to the first and second end portions of the support bar. The first and second bearing assemblies can each comprise a pivotal bearing coupled to a linear bearing. Each of the linear bearings can slidably receive a respective torsion arm so that the torsion arms guide movement of the tire assembly from a starting position to a lift completion position and back to the starting position.

Systems and methods for using the disclosed exercise apparatus are also described.

In use, it is contemplated that the disclosed exercise apparatus can provide the benefits of an adjustable weight tire-flipping exercise in a fixed, relatively small space. It is further contemplated that the disclosed exercise apparatus can allow for adjustment of the weight of the tire being flipped from one side to another. It is further contemplated that the disclosed exercise apparatus can provide for the safety for the user during the lift attempt by limiting the rate of descent of the tire in the event the lift is unsuccessful. It is further contemplated that the disclosed apparatus can be intuitive to use, and can be durable and relatively inexpensive to manufacture.

Additional advantages of the disclosed system and method will be set forth in part in the description which follows, and in part will be understood from the description, or may be learned by practice of the disclosed system and method. The advantages of the disclosed system and method will be realized and attained by means of the elements and combinations particularly pointed out in the appended claims. It is to be understood that both the foregoing general description and the following detailed description are exemplary and explanatory only and are not restrictive of the invention as claimed.

BRIEF DESCRIPTION OF THE DRAWINGS

The accompanying drawings, which are incorporated in and constitute a part of this specification, illustrate several embodiments of the disclosed apparatus, system, and method and together with the description, serve to explain the principles of the disclosed apparatus, system, and method.

FIG. 6A is an isolated perspective view of the base of the exercise apparatus. FIG. 6B is an isolated perspective view of a support wall of the exercise apparatus. FIG. 6C is a top view of the base of the exercise apparatus. FIG. 6D is a side view of the base of the exercise apparatus. FIG. 6E is a side view of a support wall of the exercise apparatus.

FIGS. 7A-7G depict isolated and partially isolated views of various components of the disclosed exercise apparatus. FIG. 7A is an isolated perspective view of a tire assembly of the disclosed exercise apparatus. FIG. 7B is an isolated perspective view of a tire of the disclosed exercise apparatus. FIG. 7C is a side view of a tire of the disclosed exercise apparatus. FIG. 7D is a close-up view of region A, as depicted in FIG. 7C. FIG. 7E is an isolated perspective view of an exemplary support bar of a tire assembly as disclosed herein. FIG. 7F is an isolated perspective view of an exemplary clutch bearing as disclosed herein. FIG. 7G is a side view of an exemplary clutch bearing as disclosed herein.

FIG. 8A depicts an exemplary tire assembly in a start position with a user positioned to begin lifting the tire assembly. FIG. 8B depicts the initiation of the lift process. FIG. 8C depicts the completion of the lift process, with the tire assembly in a peak vertical position. FIG. 8D depicts the tire assembly as it passes over the peak vertical position. FIG. 8E depicts the tire assembly after it has been fully flipped as disclosed herein. FIG. 8F depicts the tire assembly as it begins its return to the start position via gravity. FIG. 8G depicts the tire assembly after it has fully returned to the start position.

DETAILED DESCRIPTION

Figure 1:
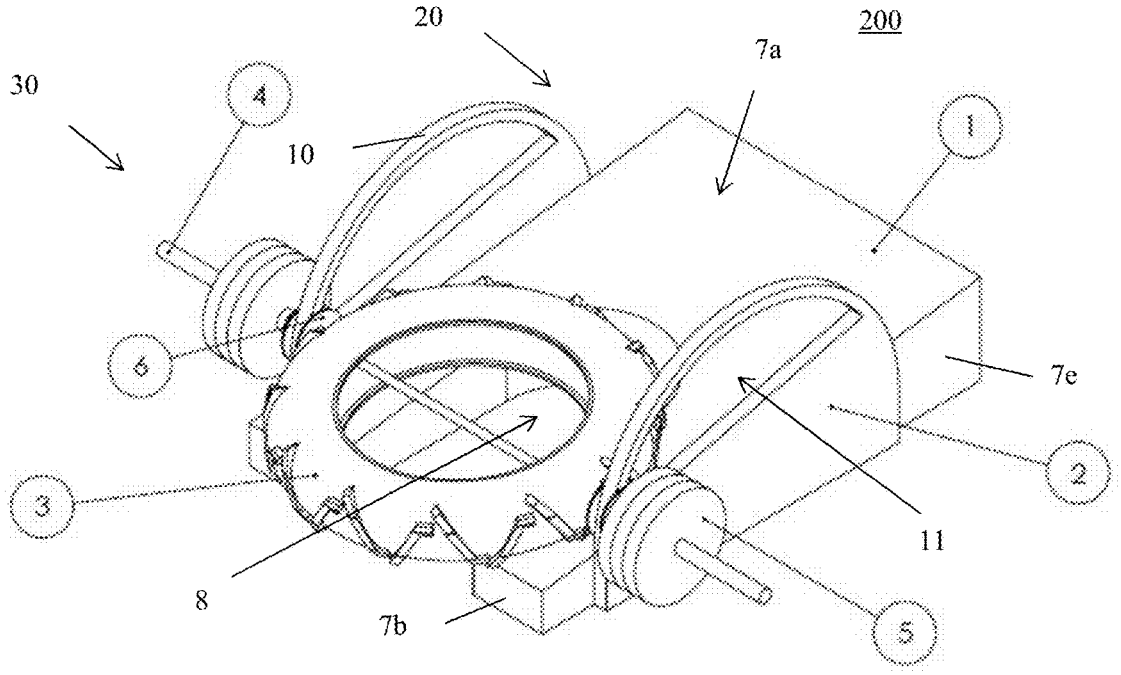
FIG. 1 is a right perspective view of the disclosed exercise apparatus, shown with the tire in the lowered/starting position.

The disclosed system and method may be understood more readily by reference to the following detailed description of particular embodiments and the examples included therein and to the Figures and their previous and following description.

A. Definitions

It is to be understood that the terminology used herein is for the purpose of describing particular embodiments only, and is not intended to limit the scope of the present invention which will be limited only by the appended claims.

It must be noted that as used herein and in the appended claims, the singular forms "a", "an", and "the" include plural references unless the context clearly dictates otherwise. Thus, for example, reference to "a sensor" includes a plurality of such databases, and reference to "the sensor" is a reference to one or more sensors and equivalents thereof known to those skilled in the art, and so forth.

"Optional" or "optionally" means that the subsequently described event, circumstance, or material may or may not occur or be present, and that the description includes instances where the event, circumstance, or material occurs or is present and instances where it does not occur or is not present.

Ranges may be expressed herein as from "about" one particular value, and/or to "about" another particular value. When such a range is expressed, also specifically contemplated and considered disclosed is the range¬ from the one particular value and/or to the other particular value unless the context specifically indicates otherwise. Similarly, when values are expressed as approximations, by use of the antecedent "about," it will be understood that the particular value forms another, specifically contemplated embodiment that should be considered disclosed unless the context specifically indicates otherwise. It will be further understood that the endpoints of each of the ranges are significant both in relation to the other endpoint, and independently of the other endpoint unless the context specifically indicates otherwise. Finally, it should be understood that all of the individual values and sub-ranges of values contained within an explicitly disclosed range are also specifically contemplated and should be considered disclosed unless the context specifically indicates otherwise. The foregoing applies regardless of whether in particular cases some or all of these embodiments are explicitly disclosed.

In some optional aspects, when values or conditions are approximated by use of the term "substantially," it is contemplated that values within up to 15%, up to 10%, or up to 5% (above or below) of the particular value or condition can be included within the scope of those aspects.

Unless defined otherwise, all technical and scientific terms used herein have the same meanings as commonly understood by one of skill in the art to which the disclosed apparatus, system, and method belong. Although any apparatus, systems, and methods and materials similar or equivalent to those described herein can be used in the practice or testing of the present apparatus, system, and method, the particularly useful methods, devices, systems, and materials are as described. Publications cited herein and the material for which they are cited are hereby specifically incorporated by reference. Nothing herein is to be construed as an admission that the present invention is not entitled to antedate such disclosure by virtue of prior invention. No admission is made that any reference constitutes prior art. The discussion of references states what their authors assert, and applicants reserve the right to challenge the accuracy and pertinence of the cited documents. It will be clearly understood that, although a number of publications may be referred to herein, such reference does not constitute an admission that any of these documents forms part of the common general knowledge in the art.

Throughout the description and claims of this specification, the word "comprise" and variations of the word, such as "comprising" and "comprises," means "including but not limited to," and is not intended to exclude, for example, other additives, components, integers or steps. In particular, in methods stated as comprising one or more steps or operations it is specifically contemplated that each step comprises what is listed (unless that step includes a limiting term such as "consisting of"), meaning that each step is not intended to exclude, for example, other additives, components, integers or steps that are not listed in the step.

B. Tire Flipping Systems and Methods

Disclosed herein is an exercise apparatus that permits execution of a "tire flipping" weight lift exercise. Whereas the conventional act of "tire flipping" requires a large space and can be hazardous due to the use of a large, heavy, free falling tire, the apparatus disclosed herein can provide for a stationary flipping action that is braked to provide for a soft landing if the flip is successful, a safe reset that prevents injury to the user if the flip is unsuccessful, a lifted weight that is adjustable using convenient plates, and a recessed area for the user to step into to complete the lifting motion in a posture that is biomechanically similar to an actual tire flip. As further disclosed herein, in some optional aspects, it is contemplated that these actions can be accomplished through the use of a guide assembly that defines the translational motion of the tire assembly as disclosed herein. Optionally, the guide assembly can comprise side (guide) rails, roller bearings (e.g., clutch bearings) with a speed control clutch and/or one way movement, and an angled landing pad that safely returns the tire to the original position using gravity when the lift has been completed. Optionally, as further described herein, free spinning or motorized rollers can engage the tire assembly at the completion of a lift to further assist with return of the tire assembly to a starting position. It is contemplated that the disclosed apparatus can be safe, simple to use, and similar to a traditional free standing tire flip while providing a design that is durable, cost effective, and easy to manufacture.

Figure 2:
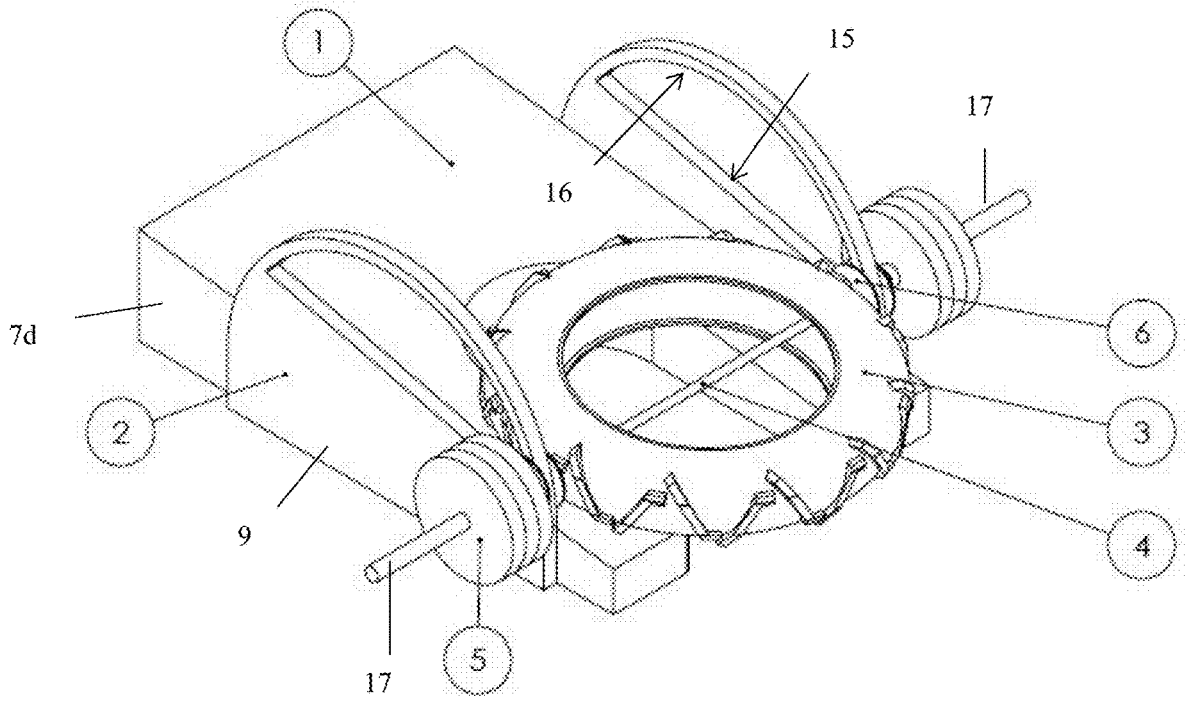
FIG. 2 is a left perspective view of the disclosed exercise apparatus, shown with the tire in the lowered/starting position.
Figure 3:
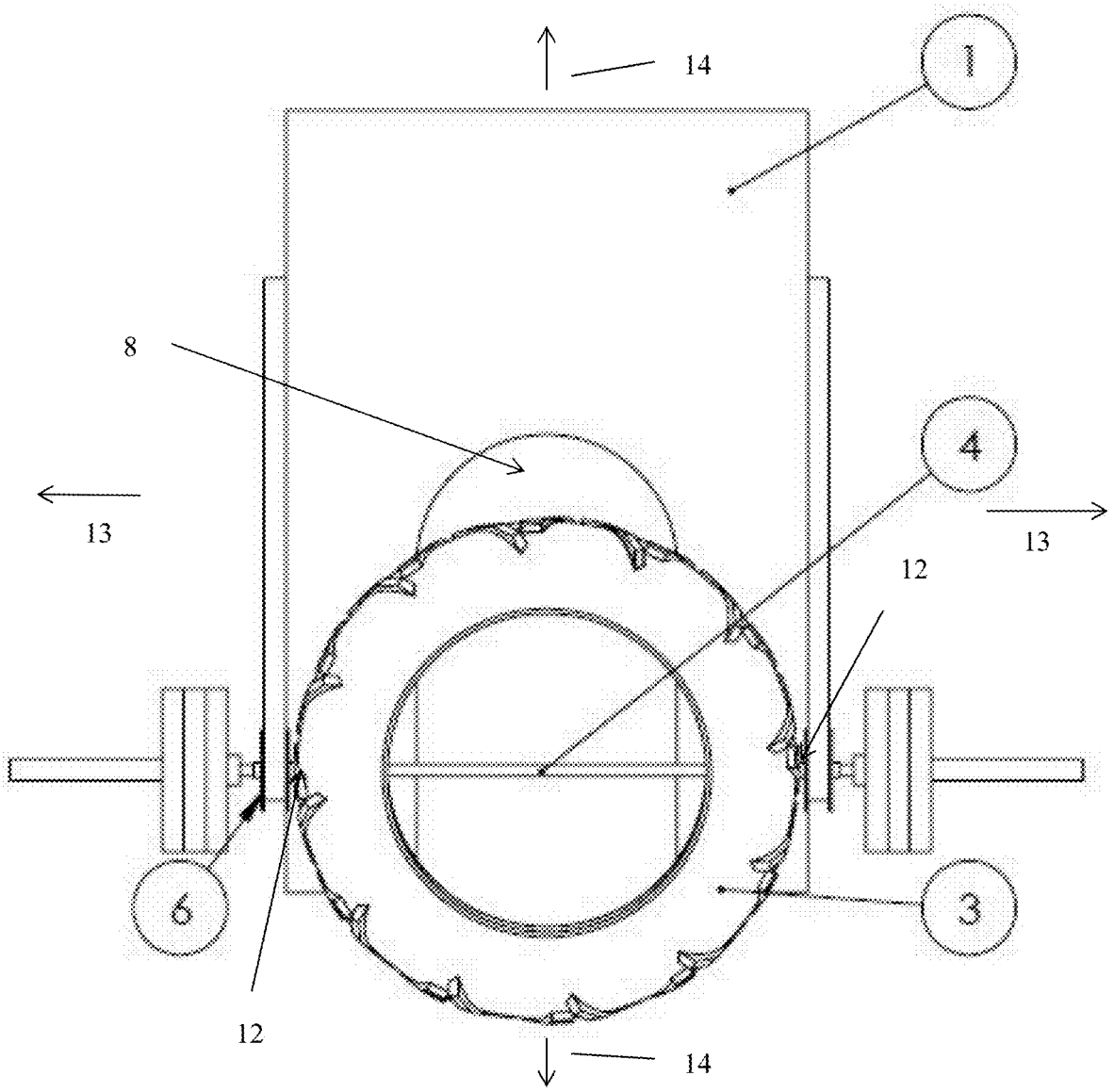
FIG. 3 is a top (overhead) view of the disclosed exercise apparatus, shown with the tire in the lowered/starting position.
Figure 4:
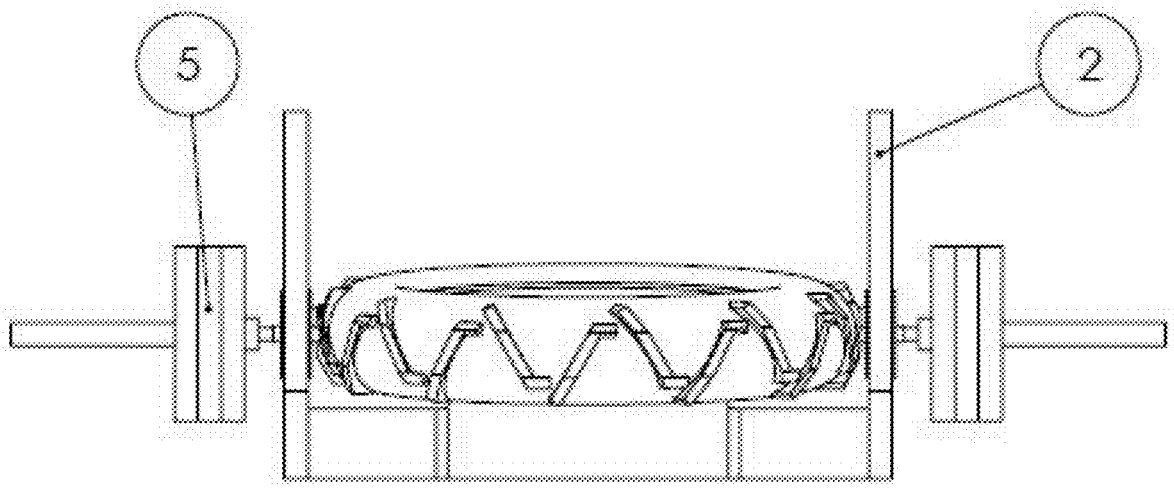
FIG. 4 is a front view of the disclosed exercise apparatus, shown with the tire in the lowered/starting position.
Figure 5:
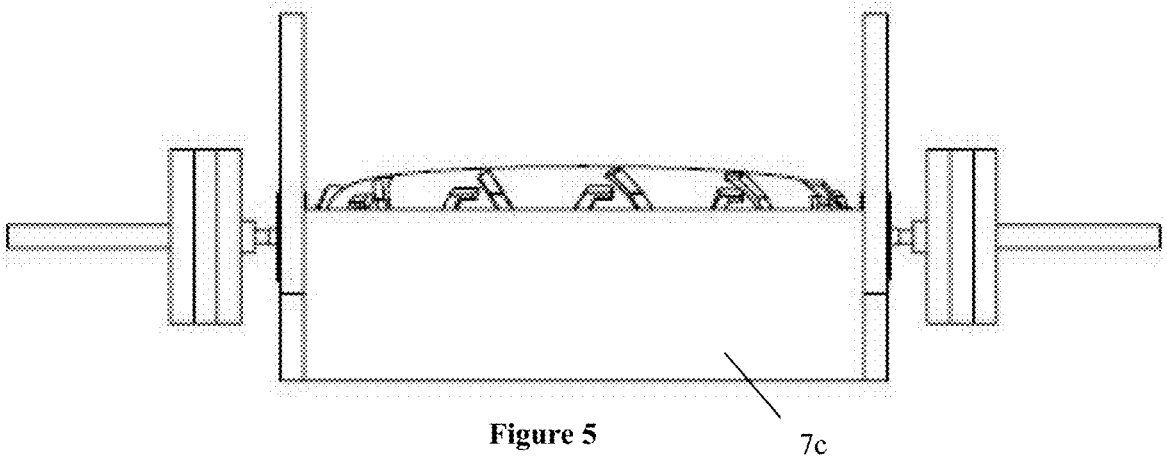
FIG. 5 is a back view of the disclosed exercise apparatus, shown with the tire in the lowered/starting position.
Figure 6B:
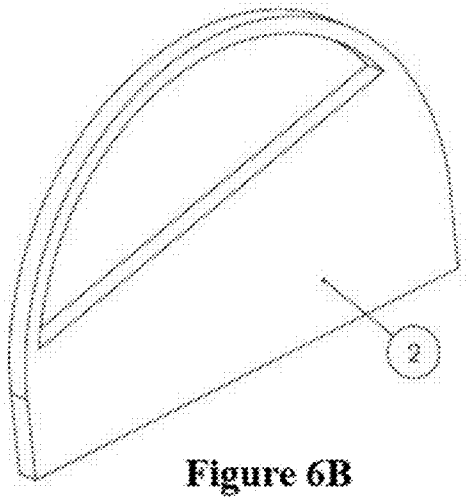
FIGS. 6A-6E depict isolated views of various components of the disclosed exercise apparatus.
Figure 6E:
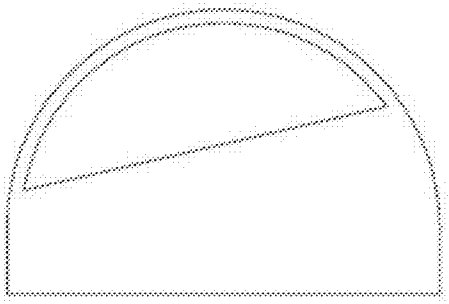
Figure 6A:
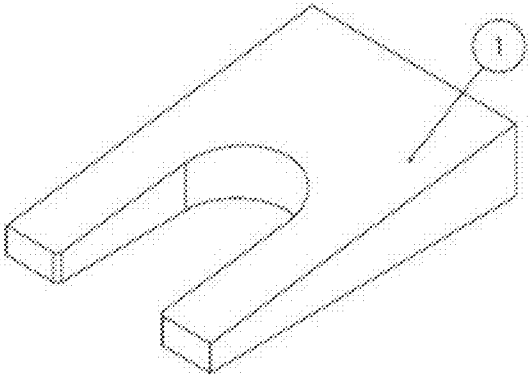
Figure 6D:
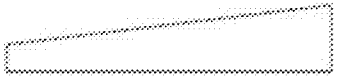
Figure 6C:
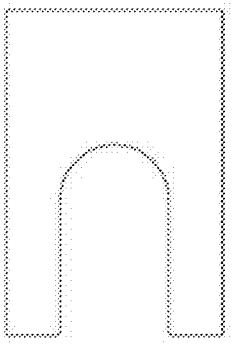

FIGS. 1 through 9 illustrate an exercise apparatus 200 for use by a person on a firm and level support surface. In exemplary aspects, the exercise apparatus 200 can comprise a chassis 20 and a tire assembly 30. In these aspects, the chassis 20 can comprise a base portion 1 and a guide assembly that controls movement of the tire assembly during a lift as further disclosed herein. In these aspects, the guide assembly can comprise first and second support walls 2. As shown in FIGS. 1-5, the base portion 1 can have an upper surface 7*a*, opposed front and back surfaces 7*b*, 7*c*, and opposed first and second side surfaces 7*d*, 7*e*. In exemplary aspects, and as shown in FIGS. 1-2, the upper surface 7*a* can have an upward slope moving from the front surface 7*b* toward the back surface 7*c* relative to an axis of movement 14 as labeled in FIG. 3. In these aspects, it is contemplated that the angle of this upward slope can be selected to be the minimum angle required to ensure a safe and continuous return motion of the tire assembly, which is a function of the coefficient of friction of the upper surface. Optionally, it is contemplated that the angle of the upward slope can range from about 3 degrees to about 15 degrees. In further aspects, the first and second support walls 2 can have lower portions 9 that are respectively secured to the first and second side surfaces 7*d*, 7*e* of the base portion 1. In these aspects, it is contemplated that portions of each of the first and second support walls 2 can extend upwardly from the upper surface 7*a* of the base portion 1. Optionally, in exemplary aspects, each of the first and second support walls 2 can further comprise a guide rail 10 having an arcuate profile moving along the axis of movement 14. In these aspects, an upper surface 15 of the lower portion 9 and a lower surface 16 of the guide rail 10 of each support wall 2 can cooperate to define an opening 8 within the support wall. It is contemplated that the upper surface 15 of the lower portion 9 of each support wall 2 can have an upward slope (moving from toward the back surface 7*c* of the base portion 1) that is equal or substantially equal to the slope of the upper surface 7*a* of the base portion of the chassis 20. The base portion 1 and the support walls 2 of the chassis 20 can comprise a strong, durable, metallic material. However, it is contemplated that the base portion 1 and the support walls 2 can comprise any suitably strong, rigid and durable material.

In additional aspects, the tire assembly 30 can comprise a tire 3 defining first and second through-openings 12 positioned in alignment relative to a transverse axis 13 that is perpendicular to the axis of movement 14. In these aspects, the tire assembly 30 can comprise a support bar 4 extending through the first and second through-openings 12 of the tire 3. It is contemplated that the tire 3 can comprise an elastomeric tire as is known in the art. It is further contemplated that the tire 3 can be selectively rotatable relative to the support bar 4. In another aspect, the tire 3 can be positioned between opposing first and second end portions 17 of the support bar 4 relative to the transverse axis 13. In this aspect, the first end portion of the support bar 4 can extend through the opening of the first support wall of the chassis 20, and the second end portion of the support bar 4 can extend through the opening of the second support wall of the chassis. In further aspects, first and second clutch bearings 6 can be respectively coupled to the first and second end portions 17 of the support bar 4. In use, it is contemplated that the first and second clutch bearings 6 can respectively engage the lower surfaces 16 of the guide rails 10 of the first and second support walls 2 to permit controlled movement of the support bar 4 along the arcuate profiles of the guide rails in response to lifting (and ultimately, flipping) of the tire.

Optionally, the tire assembly can further comprise a plurality of weight members 5 (e.g., plate weights). In some aspects, at least a first weight member can be removably secured to the first end portion of the support bar 4, and at least a second weight member can be removably secured to the second end portion of the support bar. In further aspects, the tire assembly 30 can further comprise at least one locking mechanism, such as a locking collar, that is configured to selectively and removably secure plate weights or other weight members to the support bar 4. It is contemplated that such locking mechanisms can ensure that the weight members do not become dislodged during use.

Optionally, in further aspects, the base portion 1 of the chassis 20 can define a recess opening 8 extending from the front surface 7*b* of the base portion toward the back surface 7*c*. In these aspects, the recess opening 8 can be configured to receive at least one leg of a user during lifting of the tire 3.

Figure 9:
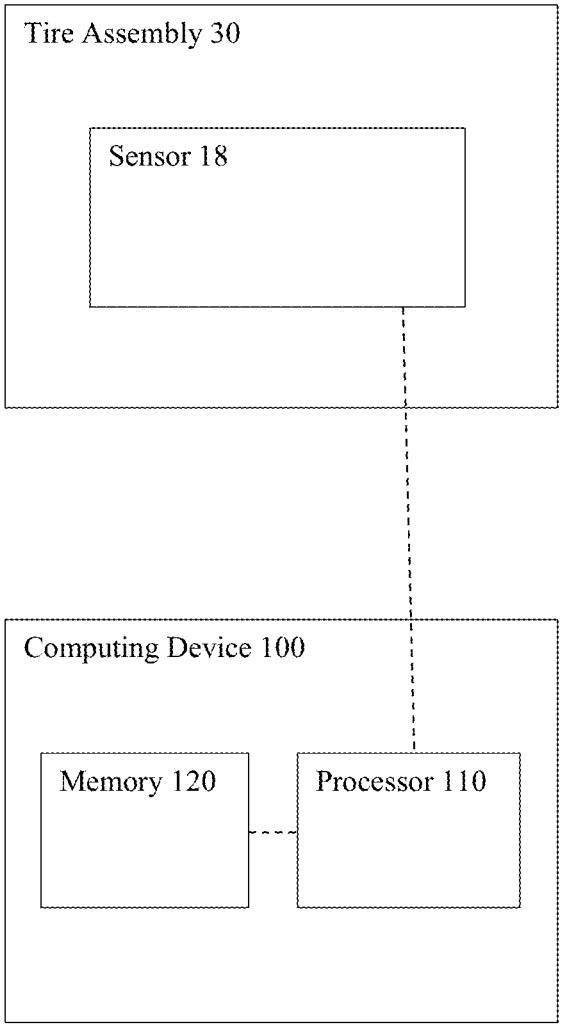
FIG. 9 is a schematic diagram of an exemplary sensor that is coupled to the tire assembly and communicatively coupled to a computing device.

Optionally, in still further aspects, and with reference to FIG. 9, the tire assembly 30 of the exercise apparatus 200 can further comprise a sensor 18 coupled to the tire 3. In these aspects, the sensor 18 can be configured to produce an output indicative of at least one parameter associated with movement of the tire 3. Exemplary parameters include acceleration, velocity, force, position, displacement, and rotation. Exemplary sensors include accelerometers, gyros, force sensors, linear potentiometers, angular transducers, and the like. Optionally, the sensor 18 can be positioned within an interior portion of the tire. In other optional configurations, it is contemplated that the sensor 18 can be coupled to a portion of the support bar 4. In some optional aspects, the tire assembly 30 can further comprise one or more instrument supports or receptacles (not shown) that are configured to support (and, optionally, receive) the sensor 18. Optionally, the sensor 18 can be an electronic smart phone sensor that is configured to produce at least one output indicative of the effort of the user during exercise. Optionally, the tire assembly 30 can comprise a plurality of sensors 18 as disclosed herein.

In exemplary aspects, it is contemplated that the exercise apparatus 200 can be provided as a component of an exercise system. In these aspects, and with reference to FIG. 9, it is contemplated that the exercise system can further comprise a computing device 100 having a processor 110 that is communicatively coupled to the sensor 18 of the tire assembly and configured to receive the output from the sensor. Optionally, the computing device 100 can comprise a desktop computer, a laptop computer, a tablet, a smartphone, and/or a cloud-based computing device. In addition to the processor 110, it is contemplated that the computing device 100 can further comprise a memory 120 that is communicatively coupled to the processor and configured to store data received from the sensor 18. It is further contemplated that the memory 120 can store software to be executed by the processor to permit evaluation of the parameters measured by the sensor. Optionally, the computing device can comprise a display (not shown) that is communicatively coupled to the processor and configured to produce a visual output indicative of the data received from the sensor 18.

In exemplary aspects, the disclosed apparatus 200 can be used to perform an exercise method. In these aspects, the exercise method can comprise lifting the tire of the tire assembly of the exercise apparatus. It is contemplated that lifting the tire can comprise advancing the tire from a starting position to a lift completion position at a distal end of the guide rails of the support walls of the chassis. In another aspect, it is contemplated that advancing the tire from the starting position to the lift completion position can comprise flipping the tire past a fully vertical position. In additional aspects, the exercise method can further comprise allowing the tire to return to the starting position from the lift completion position. In these aspects, it is contemplated that the first and second clutch bearings of the tire assembly can engage the upper surfaces of the lower portions of the first and second support walls, and the tire can return to the starting position at least partially due to a gravitational force (and the downward slope of the upper surfaces of the lower portions of the support walls of the chassis). In some optional aspects, the chassis can include rollers that are configured to engage at least a portion of the tire assembly upon completion of a lift or flip. In these aspects, it is contemplated that the rollers can be free spinning or motorized to further assist return of the tire to the starting position. In exemplary aspects, the rollers can be configured for rotation about a rotational axis that is parallel or substantially parallel to the transverse axis 13.

In further exemplary aspects, the disclosed exercise apparatus can be used by a person on a firm and level support surface, with a bottom side of the chassis being configured for resting on the support surface. Optionally, the support surface can be a flooring surface. Alternatively, it is contemplated that the support surface can be a raised platform that adjusts the operative height of the exercise apparatus. As further disclosed herein, the guide rails of the chassis can support the tire assembly in a manner that allows the tire assembly, which itself supports adjustable plate weights, to be flipped within the chassis. As further disclosed herein, the upper surfaces of the chassis and the lower portions of the support walls can be designed to allow gravity to return the tire assembly to its starting position in a speed controlled manner at the completion of the lift.

It is contemplated that the tire assembly can have at least a first side and an opposed second side. As further disclosed herein, the tire assembly can be configured for rotational engagement within the openings of the chassis support walls. In use, the tire assembly can rest on the lower front portion of the upper surface of the base portion of the chassis at the beginning and end of each lift. When a user grasps the edge of the elastomeric tire and lifts the tire upward, the tire assembly begins to pivot upward about the fulcrum, which is the opposite edge of the elastomeric tire (from where the user grasped the tire). The tire assembly is confined within the openings of the chassis support walls such that it must pivot upward in a controlled manner that prevents damage to the tire assembly or support walls or injury or pain to the user. Optionally, it is contemplated that the lower, front section of the upper surface of the base portion of the chassis can be treated with a friction-enhancing material or provided with a friction-enhancing structure (e.g., a high friction rubber pad) to prevent or reduce the risk of slippage of the tire, thereby avoiding unstable or uncontrolled motions.

If the user failed to complete the lift, the clutched bearings, which are engaged with the chassis guide rails, can prevent the tire assembly from falling back upon the user in an aggressive manner due to gravity. Additionally, if the user completes the lift and the tire assembly crosses a transverse plane that is perpendicular to the level support surface, the clutched bearings within the chassis guide rails prevent the tire assembly from falling over in an aggressive manner due to gravity. Instead, when the pivot motion is complete and the tire assembly comes to a rest on the top, inclined surface of the lower portions of the support walls of the chassis, the slope of the surface is designed to allow gravity to gently return the tire assembly to its starting position. The return to the start position of the tire assembly may be facilitated by rollers, motors, bearings, or other conventional friction-reducing mechanisms. The speed of the downhill motion of the tire assembly can be controlled by one or more braking members, which can be configured to engage portions of the support wall to decrease the rate of movement from the lift-completion position of the tire assembly to the starting position, thereby ensuring the safety of the user.

Preferably, although not required, the clutched bearings can be strongly magnetized such that they must maintain contact with the guide rails on the chassis support walls. Preferably, although not required, the clutched bearings can have elongated or enlarged side portions that extend circumferentially around at least a portion of the guide rails to further control the pivotal motion of the tire assembly in a manner that prevents damage to the tire assembly or support walls or injury or pain to the user. It is contemplated that grooves, cogs, or other friction-enhancing structures can be used between the chassis guide rails and the clutched bearings.

In use, as further disclosed herein, it is contemplated that the weighted support bar, which extends through the tire, can permit the addition of weight members to thereby increase the difficulty of the lift. Because the weighted support bar extends through the openings of the support walls of the chassis, the support bar also supports the clutched bearings that ensure a safe and controlled tire flip motion.

As further disclosed herein, and in contrast to other exercise devices, the disclosed tire assembly includes an actual, complete tire. Because the tire is an actual, complete tire, there is not an excessive amount of exposed frame structure through which a user may accidentally experience an injury during use. This design feature optimizes both safety for the user and reliability for the device.

Additionally, in contrast to other exercise devices, the disclosed tire assembly can include adjustable load weights that are on the outside of the tire. More particularly, unlike existing carriages that are designed to simulate tires and that have internal receptacles for weight, the disclosed tire assembly permits selective placement and adjustment of weights at a location outside of the tire (or tire carriage). This external mounting of weights allows for consistency with other weight systems that are currently used by high performance athletes at the high school, collegiate, and professional levels.

It is contemplated that the disclosed clutch bearings (e.g., clutched roller bearings) can be similar to those used in industrial conveyor systems to control the (successful lift) forward and (failed lift) backward motion of the loaded tire. This capability improves the durability of the exercise apparatus, which can be loaded with very heavy weights. Additionally, unlike less rugged hydraulic pistons, it is contemplated that the disclosed clutch bearings will not experience performance variation as a function of temperature and age.

It is further contemplated that the recessed opening or platform of the disclosed apparatus can provide a space for users to step when lifting the tire to complete the flipping motion. Without such a place to step, the risk of injury would be increased because the user would be required to extend their body in an awkward manner to follow through with the lift. Thus, it is contemplated that the disclosed apparatus avoids these problems and provides a simulation of an actual tire flip.

Figure 13:
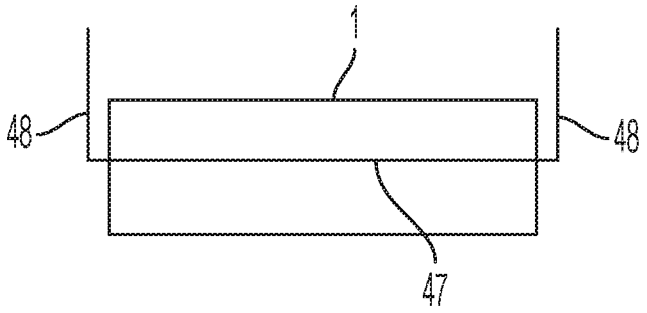
FIG. 13 is a schematic view of a base portion and a torsion bar of the exercise apparatus as in FIG. 10.

FIGS. 10-13 illustrate another exemplary embodiment of an exercise apparatus 300 as disclosed herein that includes similar elements to that of the exercise apparatus 200 and, accordingly, uses similar reference numbers where appropriate. The tire 3 has a plurality of aligned openings that receive the support bar 4 therethrough. The apparatus 300 can comprise guide rails 10 that confine the range of movement of the tire assembly by ensuring that the end portions of the support bar remain below the guide rails (and within the opening defined by the guide rails). The support bar pivotably couples to pivotal bearings 40 (one shown) that, in turn, couple with linear bearings 42 via a bracket (e.g., an L-bracket) 44. In exemplary aspects, the guide assembly of the exercise apparatus can comprise a torsion bar 46. The linear bearings 42 can slide along respective parallel arms 48 of the torsion bar 46. As shown in FIG. 13, the parallel arms 48 can connect via a connecting section 47 that passes through the base portion 1 such that the two arms 48 are positioned on opposing sides of the base portion. Accordingly, the torsion bar 46 can comprise a U-shaped bar that pivotably couples with the base portion 1 about an axis 52 that extends beneath the upper surface 7*a* of the base portion 1 and, optionally, can be parallel or substantially parallel to the transverse axis 13. The torsion bar 46 can optionally be spring biased to pivot to a starting position (i.e., the position in which the tire assembly is similarly in its starting position). Distal ends of the torsion bar 46 can have stops (e.g., rubber stops) 50 so that when the linear bearings 42 connect with the stops, the stops decelerate travel of the tire assembly to a stop. In further embodiments, compression springs can be disposed between stops 50 and linear bearings 42 so that the tire assembly is more gently decelerated as it returns to the starting position.

Figure 8A:
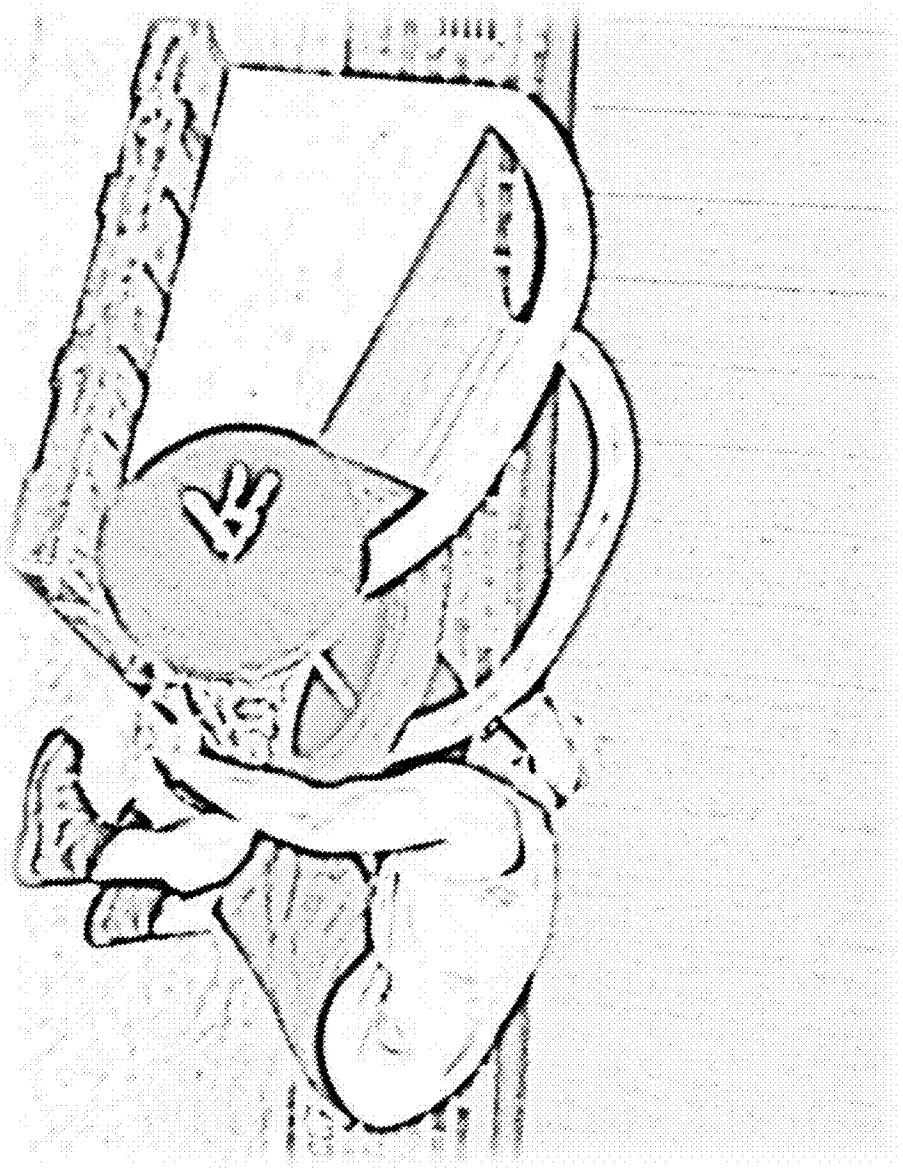
FIGS. 8A-8G depict an exemplary lift cycle as disclosed herein.
Figure 8B:
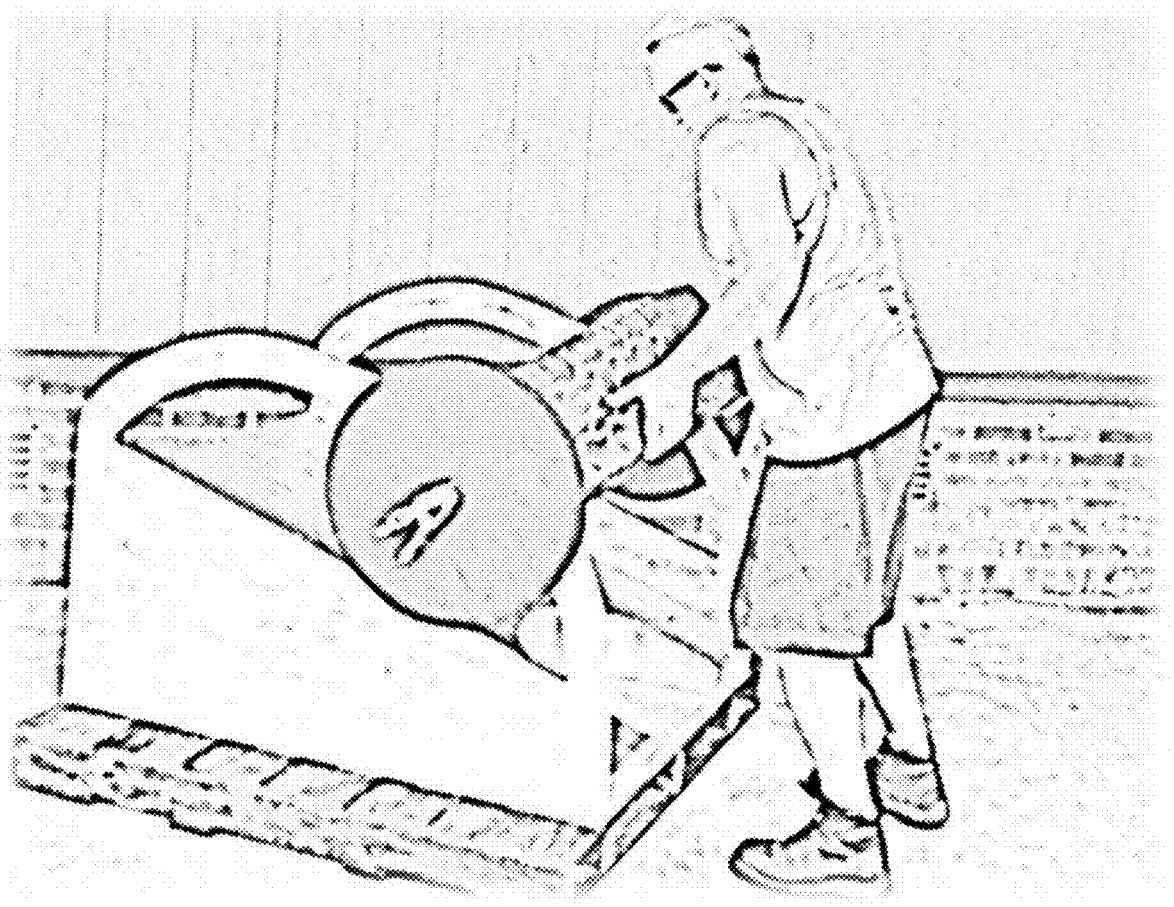
Figure 8C:
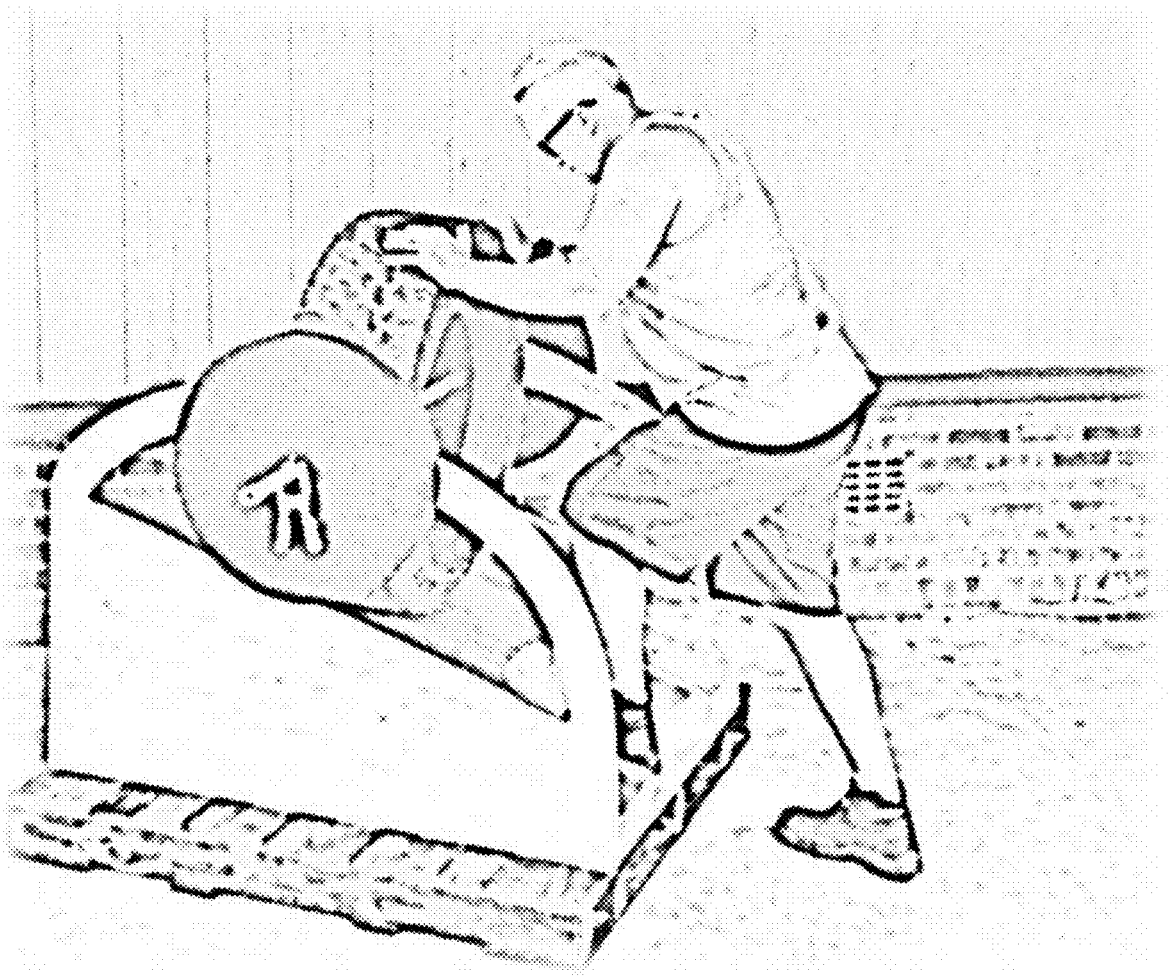
Figure 8D:
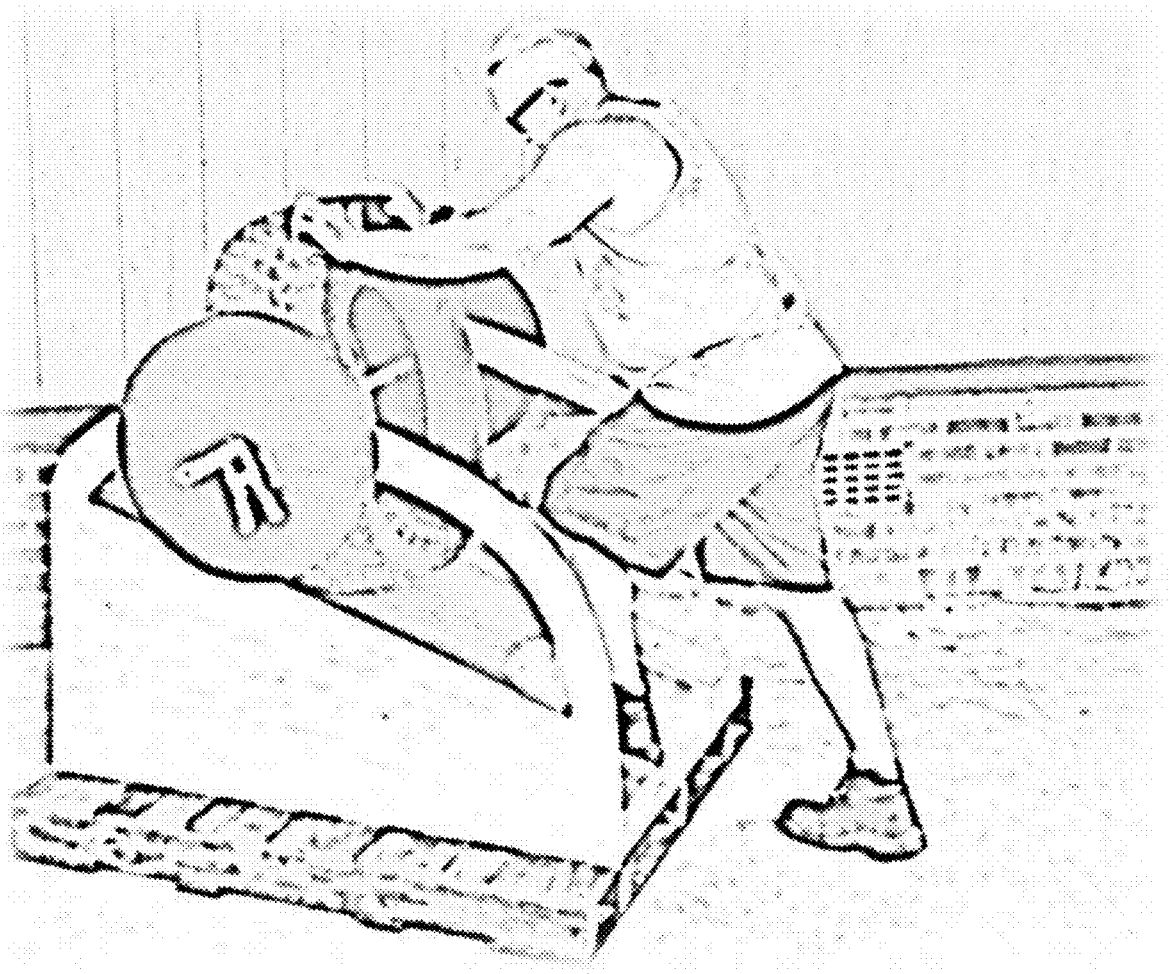
Figure 8E:
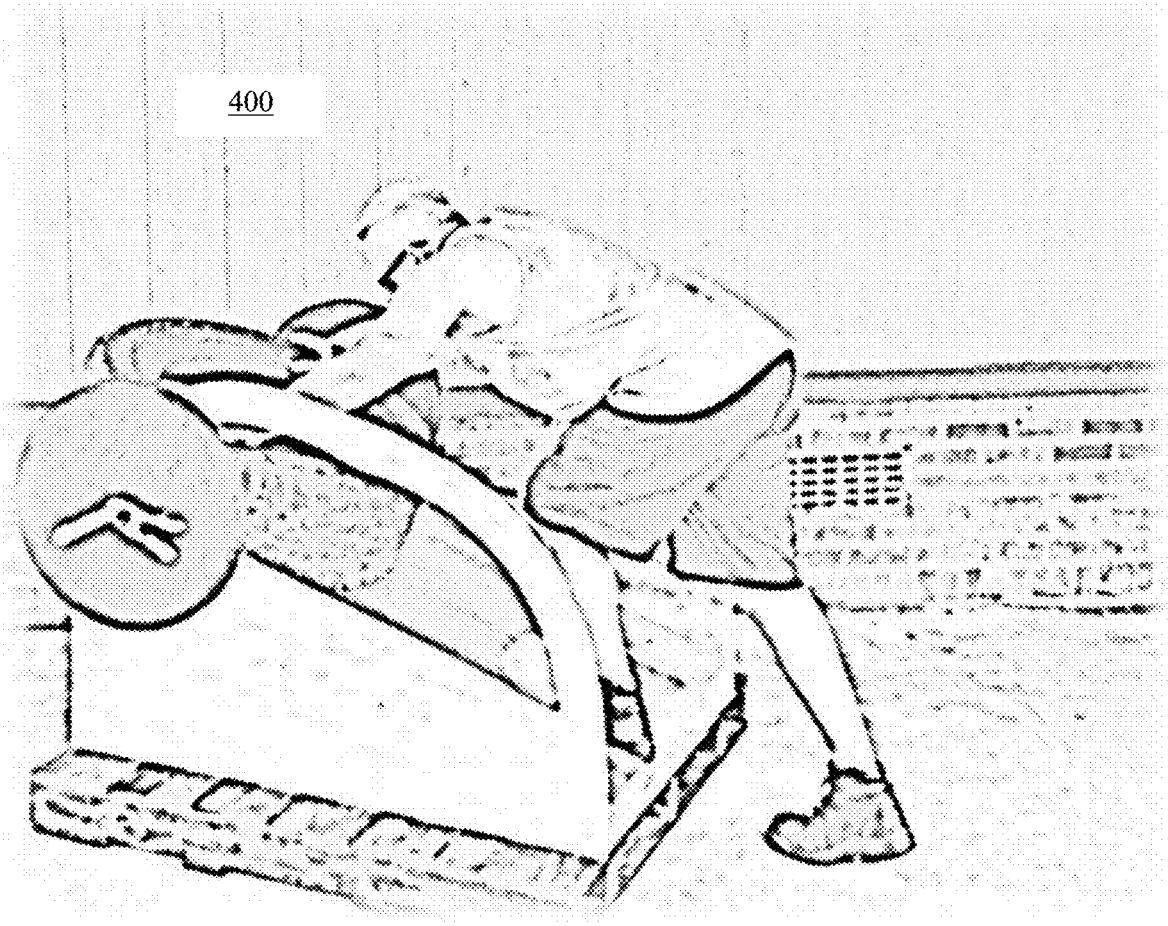
Figure 8F:
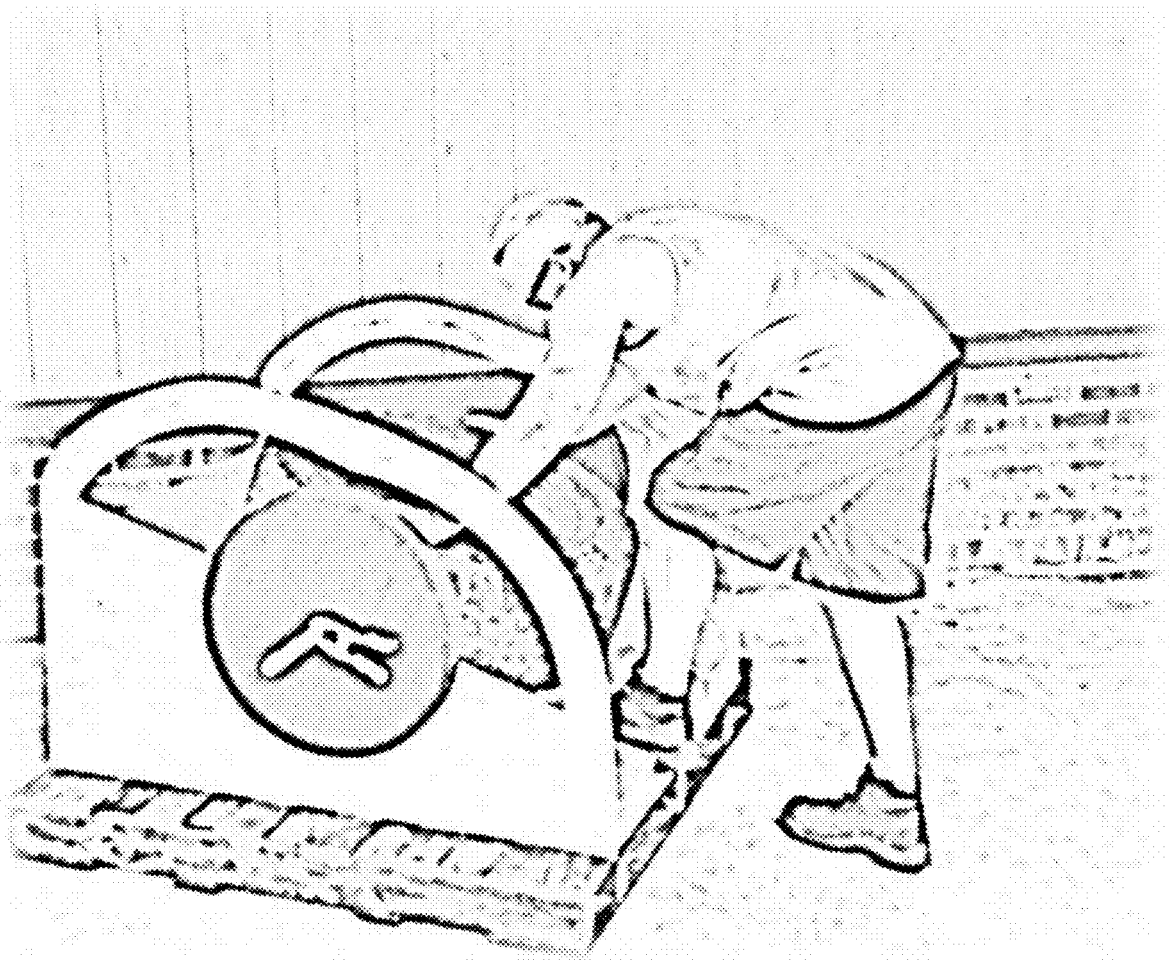
Figure 8G:
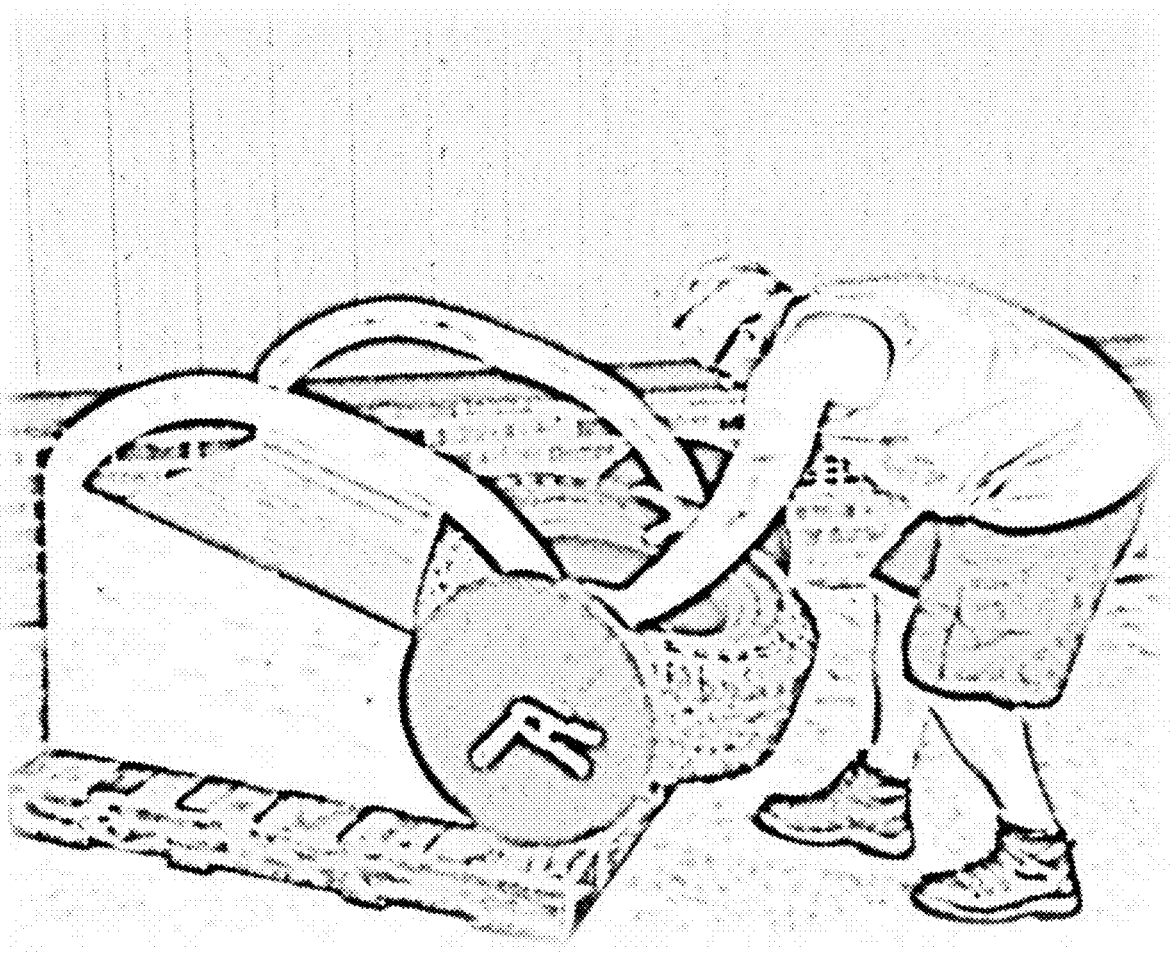
Figure 10:
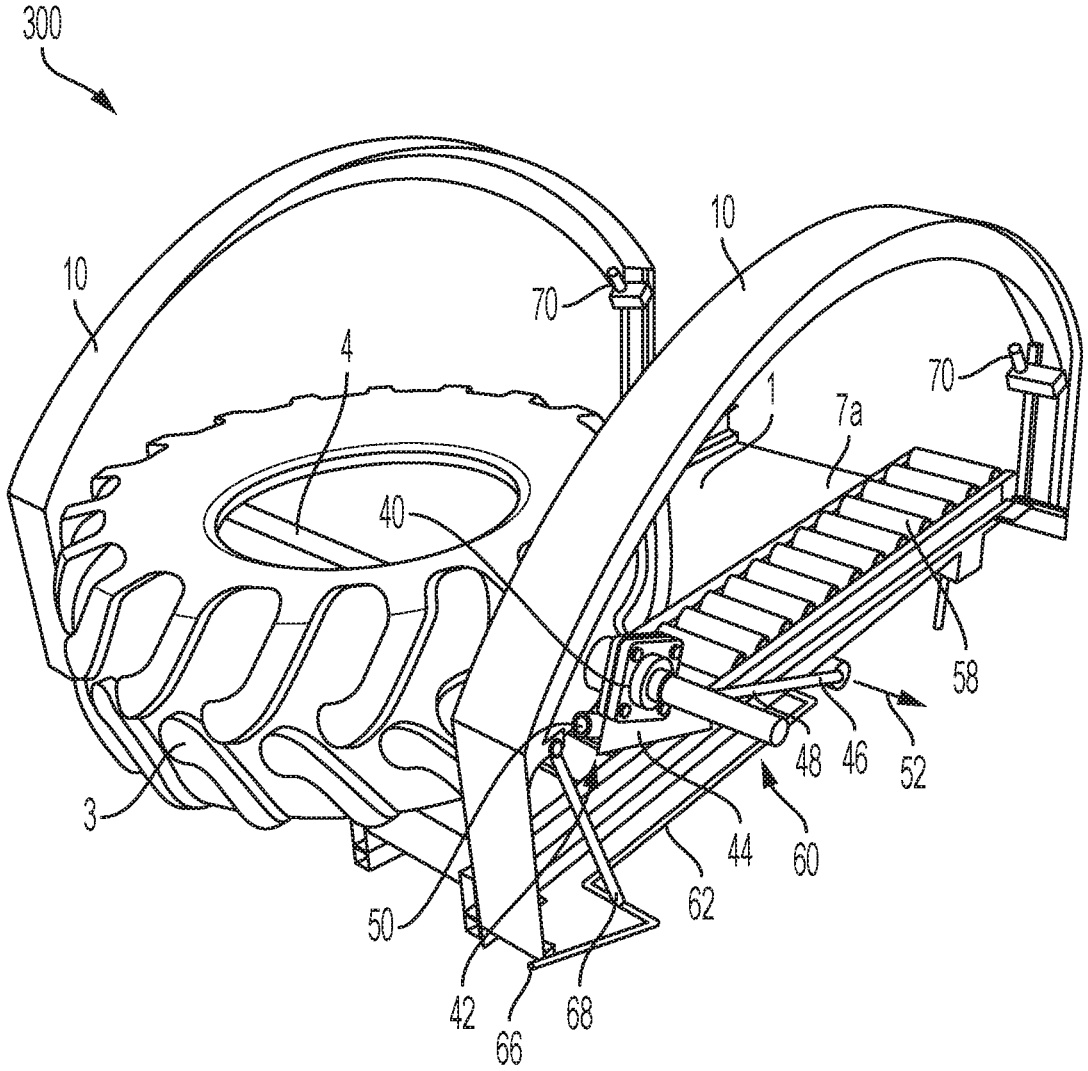
FIG. 10 is a perspective view of another exemplary exercise apparatus as disclosed herein.
Figure 11:
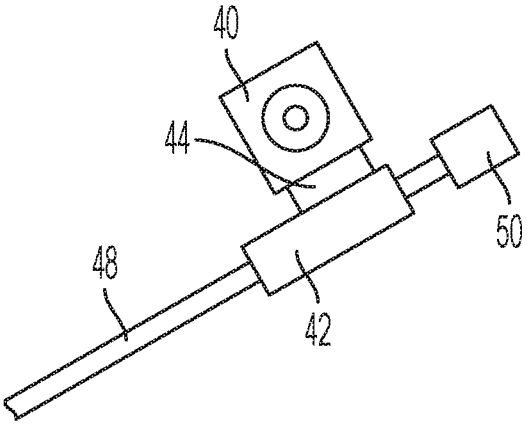
FIG. 11 is a partial side view of a torsion bar and bearing assembly of the exercise apparatus of FIG. 10.
Figure 12:
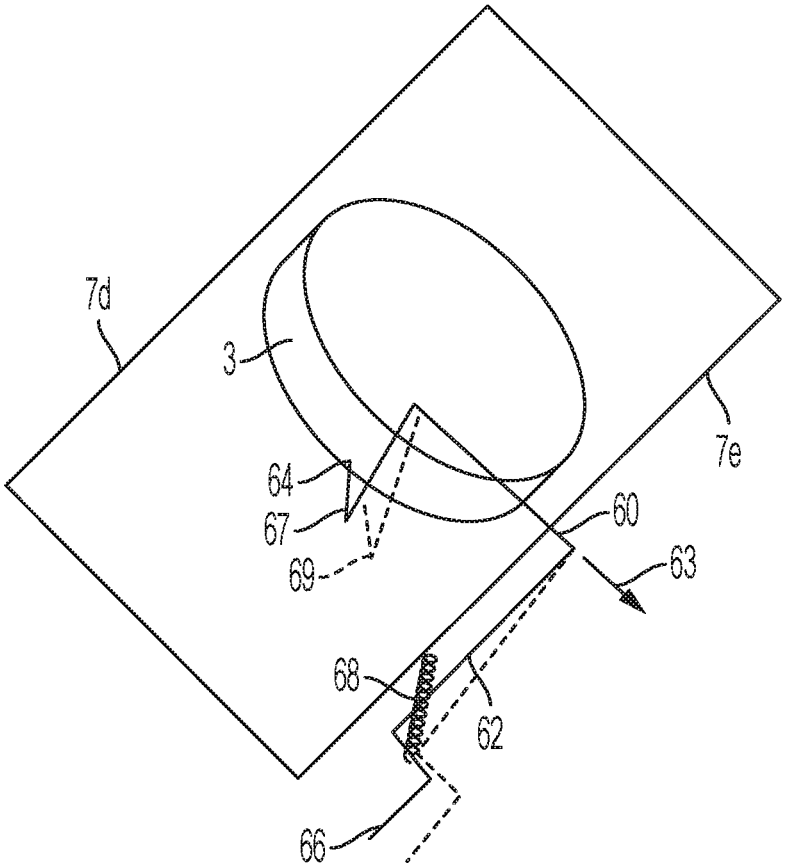
FIG. 12 is a partial schematic perspective view of the exercise apparatus as in FIG. 10.

The exercise apparatus 300 can optionally have stops (e.g., spring stops) 70 that act as back stops and engage distal ends of the torsion bar 46 as the tire is flipped. Optionally, the stops can be secured to respective portions of the guide rails 10 as shown in FIG. 10. Accordingly, the torsion bar 46 can have its range of pivotal motion limited so that it cannot pivot past stops 70. In use, the stops (e.g., spring stops) 70 can decelerate and reverse the pivotal movement of the torsion bar 46 as a tire flip exercise is completed. (FIG. 8E illustrates a lift completion position 400 of the tire.)

The base portion 1 can further include rollers 58 that engage the tire 3 as it lies parallel or substantially parallel to the upper surface 7*a* of the base portion 1, such as in the starting position or lift completion position. The rollers 58 can be pivotable about respective axes that are parallel or substantially parallel to the transverse axis 13. The rollers 58 can assist in returning the tire assembly to the starting position. In some embodiments, the rollers 58 can be free-spinning so that the weight of the tire on the sloped surface causes the rollers to rotate. In further embodiments the rollers can be motor-driven. The rollers 58 can be provided in distinct arrangements or clusters positioned on respective side, peripheral portions on the base portion 1. In exemplary aspects, within each spaced arrangement, a plurality of rollers 58 can be spaced apart relative to the direction of movement 14. In further exemplary aspects, the two spaced arrangements of rollers can be spaced relative to the transverse axis 13 so that when the tire is pivoted (flipped) sufficiently from its starting position, the tire engages the upper surface of the base portion in between the rollers so that the tire can be pivoted against a fixed surface.

The exercise apparatus 300 can include a catch 60 that mechanically engages the tire assembly to inhibit or prevent the tire assembly from returning to the starting position until a user releases the tire assembly. The catch 60 can comprise a release lever 62 that comprises an arm that pivots about an axis 63 that is substantially parallel to the pivotal axis of the torsion bar. The catch 60 can be biased into a catching position via a tension spring 68. A first end 64 of the release lever can extend upward at an approximately central position between the side surfaces 7*d*, 7*e* (within recess opening 8) and above the upper surface 7*a* of the base portion 1 so that as the tire rolls down the rollers 58, a front end of the tire engages with the first end 64 and stops. When a user presses down on a second end 66 of the release lever 62, the release lever 62 can pivot from a first position 67 to a second position 69 in which the first end 64 of the release lever drops below the upper surface 7*a*, and the catch releases the tire assembly from its stopped position and allows it to travel to the starting position. In further optional embodiments, the catch 60 can be a pawl that extends from the release lever and engages a ratchet attached to the torsion bar 46 along the torsion bar's pivotal axis. In these embodiments, the ratchet can comprise a single notch that receives the pawl beneath the upper surface 7*a* of base portion 1.

Exemplary Dimensions

Optionally, in exemplary aspects, it is contemplated that the support bar can have the same dimensions, or substantially the same dimensions, as an Olympic weight bar as is known in the art. Thus, in some exemplary aspects, it is contemplated that the total length of the support bar can be about 86.5 inches, including a grip length of about 52.5 inches, two cuff widths of about 1 and $\frac{5}{8}^{th}$ inches (1.6 inches), and two weight sections of about 15 and $\frac{3}{8}^{th}$ inches (15.4 inches). In further exemplary aspects, it is contemplated that the support bar can have other dimensions than those of an Olympic weight bar. For example, in some aspects, the total length of the support bar can be increased or decreased relative to the length of an Olympic weight bar. In these aspects, it is contemplated that the overall dimensions of the remaining components of the tire assembly, the base portion, and the support walls can be scaled as appropriate for usage with a particular support bar.

In exemplary non-limiting aspects, it is contemplated that the base of the chassis can have a length ranging from about 70 inches to about 130 inches, from about 80 inches to about 120 inches, or from about 85 inches to about 110 inches. More preferably, it is contemplated that the base of the chassis can have a length ranging from about 90 inches to about 100 inches, such as a length of about 96 inches. In further exemplary non-limiting aspects, it is contemplated that the base of the chassis can have a width ranging from about 35 inches to about 75 inches, from about 40 inches to about 70 inches, or from about 45 inches to about 65 inches. More preferably, it is contemplated that the base of the chassis can have a width ranging from about 50 inches to about 60 inches, such as a width of about 54 inches. In still further exemplary non-limiting aspects, it is contemplated that the base of the chassis can have a front height (closest to the front surface) ranging from about 2 inches to about 10 inches, from about 3 inches to about 8 inches, or from about 3.5 inches to about 7 inches. More preferably, it is contemplated that the base of the chassis can have a front height ranging from about 4 inches to about 6 inches, such as a front height of about 5 inches. In still further exemplary non-limiting aspects, it is contemplated that the base of the chassis can have a back height (closest to the back surface) ranging from about 10 inches to about 40 inches, from about 12 inches to about 35 inches, or from about 15 inches to about 30 inches. More preferably, it is contemplated that the base of the chassis can have a back height ranging from about 20 inches to about 25 inches, such as a back height of about 22 inches.

Optionally, in exemplary aspects, the guide rails can comprise steel tubes, such as, for example and without limitation, two-inch diameter steel tubes. As further disclosed herein, the specific geometry of the guide rails can be a function of the specific design of the tire that is used. However, in some exemplary non-limiting aspects, it is contemplated that the length of the disclosed support walls (and guide rails), measured along the longitudinal axis of the chassis, can range from about 40 inches to about 120 inches, from about 45 inches to about 110 inches, or from about 50 inches to about 100 inches. More preferably, it is contemplated that the length of the disclosed support walls (and guide rails) can range from about 60 inches to about 90 inches or from about 70 inches to about 80 inches, including a length of about 72 inches. In other exemplary non-limiting aspects, it is contemplated that the height of the disclosed support walls (and guide rails) at a center point of the support wall, measured relative to the upper surface of the base of the chassis and along an axis that is perpendicular to the base of the chassis, can range from about 15 inches to about 45 inches, from about 20 inches to about 35 inches, or from about 25 inches to about 30 inches, including a height of about 28 inches. At the center point of the support walls, it is further contemplated that the upper surface 15 of the lower portion 9 of each wall can be spaced from the upper surface of the base of the chassis by about 5 inches to about 10 inches, and more preferably, by about 8.5 inches (measured relative to an axis that is perpendicular to the upper surface of the base of the chassis), which distance can be equal or substantially equal to half a width of the tire. In further aspects, at the center point of the support walls, it is contemplated that the opening within the support walls can have a diameter (between the upper surface of the lower portion of the support wall and the lower surface of the guide rail) ranging from about 15 inches to about 20 inches, including a diameter of about 17.5 inches.

In still further exemplary non-limiting aspects, the recessed opening within the base of the chassis can have a length ranging from about 15 inches to about 40 inches or from about 20 inches to about 35 inches, including a length of about 26 inches. Optionally, in these aspects, the width of the recessed opening within the base of the chassis can range from about 10 inches to about 20 inches, including a width of about 15 inches.

In still further aspects, it is contemplated that the upper portion of the guide rails can have a varying radius of curvature. Optionally, in these aspects, at least a portion of the guide rails can have a radius of curvature that is equal or substantially equal to about half the overall diameter of the tire. For example, in some aspects, the tire can have an outer diameter of about 52 inches, and at least a portion of each guide rail can have a radius of curvature of about 26 inches. In further aspects, it is contemplated that at least a portion of each guide rail can be flat or substantially flat. For example, in these aspects, it is contemplated that the flat or substantially flat portion of each guide rail can be located proximate the top of the arc of each guide rail (complementary to the flattened surface of the tire), while the remainder of each guide rail can have a radius of curvature as disclosed herein.

Exemplary Aspects

In view of the described devices, systems, and methods and variations thereof, herein below are described certain more particularly described aspects of the invention. These particularly recited aspects should not however be interpreted to have any limiting effect on any different claims containing different or more general teachings described herein, or that the "particular" aspects are somehow limited in some way other than the inherent meanings of the language literally used therein.

Aspect 1

An exercise apparatus comprising: a chassis having a base portion having an upper surface, opposed front and back surfaces, and opposed first and second side surfaces, wherein the upper surface has an upward slope moving from the front surface toward the back surface relative to an axis of movement; and a torsion bar that is pivotable with respect to the base about a transverse axis that is substantially perpendicular to the axis of movement, wherein the torsion bar comprises a first arm and a second arm that extend substantially radially from the transverse axis; and a tire assembly having: a tire defining first and second through-openings positioned in alignment relative to the transverse axis; a support bar extending through the first and second through-openings of the tire, wherein the tire is positioned between opposing first and second end portions of the support bar relative to the transverse axis; and first and second bearing assemblies respectively coupled to the first and second end portions of the support bar, wherein the first and second bearing assemblies each comprise a pivotal bearing coupled to a linear bearing, wherein each of the linear bearings slidably receives a respective torsion arm so that the torsion arms guide movement of the tire assembly from a starting position to a lift completion position and back to the starting position.

Aspect 2

The exercise apparatus of aspect 1, wherein the tire assembly further comprises a plurality of weight members, wherein at least a first weight member is removably secured to the first end portion of the support bar, and wherein at least a second weight member is removably secured to the second end portion of the support bar.

Aspect 3

The exercise apparatus of aspect 1, wherein the base portion of the chassis defines a recess opening extending from the front surface of the base portion toward the back surface, wherein the recess opening is configured to receive at least one leg of a user during lifting of the tire.

Aspect 4

The exercise apparatus of claim 1, wherein the tire assembly further comprises a sensor coupled to the tire, wherein the sensor is configured to produce an output indicative of at least one parameter associated with movement of the tire.

Aspect 5

The exercise apparatus of aspect 1, wherein the pivotal bearings are clutch bearings.

Aspect 6

The exercise apparatus of aspect 1, wherein the pivotal torsion bar comprises a U-shaped bar that is pivotable about the transverse axis.

Aspect 7

The exercise apparatus of aspect 1, further comprising a catch that releasably inhibits return of the tire assembly to the starting position from the lift completion position.

Aspect 8

The exercise apparatus of aspect 7, further comprising a release lever that is configured to disengage the catch and permit return of the tire assembly to the starting position.

Aspect 9

The exercise apparatus of aspect 1, wherein the chassis comprises rollers that are configured to contact the tire when the tire assembly is in the lift completion position, wherein the rollers are configured to rotate to assist with return of the tire assembly to the starting position.

Aspect 10

The exercise apparatus of aspect 9 wherein the rollers comprise free spinning rollers.

Aspect 11

The exercise apparatus of aspect 9, wherein the rollers comprise motorized rollers.

Aspect 12

The exercise apparatus of aspect 1, wherein the chassis further comprises at least one spring stop configured to slow movement of the tire assembly along the axis of movement in a direction away from the front surface.

Aspect 13

The exercise apparatus of aspect 12, wherein the at least one spring stop is configured to engage at least one of the first arm and the second arm of the torsion bar as the tire assembly reaches the lift completion position.

Aspect 14

An exercise system comprising: an exercise apparatus comprising: a chassis having: a base portion having an upper surface, opposed front and back surfaces, and opposed first and second side surfaces, wherein the upper surface has an upward slope moving from the front surface toward the back surface relative to an axis of movement; and a torsion bar that is pivotable with respect to the base about a transverse axis that is substantially perpendicular to the axis of movement, wherein the torsion bar comprises a first arm and a second arm that extend substantially radially from the transverse axis; and a tire assembly having: a tire defining first and second through-openings positioned in alignment relative to the transverse axis; a support bar extending through the first and second through-openings of the tire, wherein the tire is positioned between opposing first and second end portions of the support bar relative to the transverse axis; and first and second bearing assemblies respectively coupled to the first and second end portions of the support bar, wherein the first and second bearing assemblies each comprise a pivotal bearing coupled to a linear bearing, wherein each of the linear bearings slidably receives a respective torsion arm so that the torsion arms guide movement of the tire assembly from a starting position to a lift completion position and back to the starting position; a sensor coupled to the tire, wherein the sensor is configured to produce an output indicative of at least one parameter associated with movement of the tire; and a computing device having a processor that is communicatively coupled to the sensor of the tire assembly and configured to receive the output from the sensor.

Aspect 15

The exercise system of aspect 14, wherein the pivotal bearings are clutch bearings.

Aspect 16

The exercise system of aspect 14, wherein the pivotal torsion bar comprises a U-shaped bar that is pivotable about the transverse axis.

Aspect 17

The exercise system of aspect 14, further comprising a catch that releasably inhibits return of the tire assembly to the starting position from the lift completion position.

Aspect 18

The exercise system of aspect 17, further comprising a release lever that is configured to disengage the catch and permit return of the tire assembly to the starting position.

Aspect 19

The exercise apparatus of aspect 14, wherein the chassis comprises rollers that are configured to contact the tire when the tire assembly is in the lift completion position, wherein the rollers are configured to rotate to assist with return of the tire assembly to the starting position.

Aspect 20

An exercise apparatus comprising: a chassis having: a base portion having an upper surface, opposed front and back surfaces, and opposed first and second side surfaces, wherein the upper surface has an upward slope moving from the front surface toward the back surface relative to an axis of movement; first and second support walls having lower portions that are respectively secured to the first and second side surfaces of the base portion, each of the first and second support walls extending upwardly from the upper surface of the base portion, each of the first and second support walls further comprising a guide rail having an arcuate profile moving along the axis of movement, wherein an upper surface of the base portion and a lower surface of the guide rail of each support wall cooperate to define an opening within the support wall; and a tire assembly having: a tire defining first and second through-openings positioned in alignment relative to a transverse axis; a support bar extending through the first and second through-openings of the tire, wherein the tire is positioned between opposing first and second end portions of the support bar relative to the transverse axis, wherein the first end portion of the support bar extends through the opening of the first support wall of the chassis, and wherein the second end portion of the support bar extends through the opening of the second support wall of the chassis; and first and second clutch bearings respectively coupled to the first and second end portions of the support bar, wherein the first and second clutch bearings respectively engage the lower surfaces of the guide rails of the first and second support walls to permit controlled movement of the support bar along the arcuate profiles of the guide rails in response to lifting of the tire.

Aspect 21

An exercise apparatus comprising a chassis, a tire assembly, and a guide assembly as disclosed herein.

Those skilled in the art will recognize, or be able to ascertain using no more than routine experimentation, many equivalents to the specific embodiments of the method and compositions described herein. Such equivalents are intended to be encompassed by the following claims.

What is claimed is:

1. An exercise apparatus comprising:

a chassis having:

a base portion having an upper surface, opposed front and back surfaces, and opposed first and second side surfaces, wherein the upper surface has an upward slope moving from the front surface toward the back surface relative to an axis of movement; and a torsion bar that is pivotable with respect to the base about a transverse axis that is substantially perpendicular to the axis of movement, wherein the torsion bar comprises a first arm and a second arm that extend substantially radially from the transverse axis; and a tire assembly having:

a tire defining first and second through-openings positioned in alignment relative to the transverse axis;

a support bar extending through the first and second through-openings of the tire, wherein the tire is positioned between opposing first and second end portions of the support bar relative to the transverse axis; and first and second bearing assemblies respectively coupled to the first and second end portions of the support bar, wherein the first and second bearing assemblies each comprise a pivotal bearing coupled to a linear bearing, wherein each linear bearings slidably receives the first or second arm of the torsion bar so that the first and second arms of the torsion bar guide movement of the tire assembly from a starting position to a lift completion position and back to the starting position.

2. The exercise apparatus of claim 1, wherein the tire assembly further comprises a plurality of weight members, wherein at least a first weight member is removably secured to the first end portion of the support bar, and wherein at least a second weight member is removably secured to the second end portion of the support bar.

3. The exercise apparatus of claim 1, wherein the base portion of the chassis defines a recess opening extending from the front surface of the base portion toward the back surface, wherein the recess opening is configured to receive at least one leg of a user during lifting of the tire.

4. The exercise apparatus of claim 1, wherein the tire assembly further comprises a sensor coupled to the tire, wherein the sensor is configured to produce an output indicative of at least one parameter associated with movement of the tire.

5. The exercise apparatus of claim 1, wherein the pivotal bearings are clutch bearings.

6. The exercise apparatus of claim 1, wherein the pivotal torsion bar comprises a U-shaped bar that is pivotable about the transverse axis.

7. The exercise apparatus of claim 1, further comprising a catch that releasably inhibits return of the tire assembly to the starting position from the lift completion position.

8. The exercise apparatus of claim 7, further comprising a release lever that is configured to disengage the catch and permit return of the tire assembly to the starting position.

9. The exercise apparatus of claim 1, wherein the chassis comprises rollers that are configured to contact the tire when the tire assembly is in the lift completion position, wherein the rollers are configured to rotate to assist with return of the tire assembly to the starting position.

10. The exercise apparatus of claim 9 wherein the rollers comprise free spinning rollers.

11. The exercise apparatus of claim 9, wherein the rollers comprise motorized rollers.

12. The exercise apparatus of claim 1, wherein the chassis further comprises at least one spring stop configured to slow movement of the tire assembly along the axis of movement in a direction away from the front surface.

13. The exercise apparatus of claim 12, wherein the at least one spring stop is configured to engage at least one of the first arm and the second arm of the torsion bar as the tire assembly reaches the lift completion position.

14. An exercise system comprising:

an exercise apparatus comprising:

a chassis having:

a base portion having an upper surface, opposed front and back surfaces, and opposed first and second side surfaces, wherein the upper surface has an upward slope moving from the front surface toward the back surface relative to an axis of movement; and a torsion bar that is pivotable with respect to the base about a transverse axis that is substantially perpendicular to the axis of movement, wherein the torsion bar comprises a first arm and a second arm that extend substantially radially from the transverse axis; and a tire assembly having:

a tire defining first and second through-openings positioned in alignment relative to the transverse axis;

a support bar extending through the first and second through-openings of the tire, wherein the tire is positioned between opposing first and second end portions of the support bar relative to the transverse axis; and first and second bearing assemblies respectively coupled to the first and second end portions of the support bar, wherein the first and second bearing assemblies each comprise a pivotal bearing coupled to a linear bearing, wherein each linear bearings slidably receives the first or second arm of the torsion bar so that the first and second arms of the torsion bar guide movement of the tire assembly from a starting position to a lift completion position and back to the starting position a sensor coupled to the tire, wherein the sensor is configured to produce an output indicative of at least one parameter associated with movement of the tire; and a computing device having a processor that is communicatively coupled to the sensor of the tire assembly and configured to receive the output from the sensor.

15. The exercise system of claim 14, wherein the pivotal bearings are clutch bearings.

16. The exercise system of claim 14, wherein the pivotal torsion bar comprises a U-shaped bar that is pivotable about the transverse axis.

17. The exercise system of claim 14, further comprising a catch that releasably inhibits return of the tire assembly to the starting position from the lift completion position.

18. The exercise system of claim 17, further comprising a release lever that is configured to disengage the catch and permit return of the tire assembly to the starting position.

19. The exercise system of claim 14, wherein the chassis comprises rollers that are configured to contact the tire when the tire assembly is in the lift completion position, wherein the rollers are configured to rotate to assist with return of the tire assembly to the starting position.

* * * * *